United States Patent [19]

Kaufmann et al.

[11] 4,324,677

[45] Apr. 13, 1982

[54] STABLE DISHWASHING AGENT COMPOSITIONS CONTAINING ACTIVE CHLORINE

[75] Inventors: Jochen Kaufmann; Theodor Altenschöpfer, both of Dusseldorf; Klaus Schumann, Erkrath; Friedel Rings, Monheim, all of Fed. Rep. of Germany

[73] Assignee: Henkel Kommanditgesellschaft auf Aktien, Dusseldorf-Holthausen, Fed. Rep. of Germany

[21] Appl. No.: 221,341

[22] Filed: Dec. 29, 1980

[30] Foreign Application Priority Data

Jan. 12, 1980 [DE] Fed. Rep. of Germany ..... 3000981
Mar. 1, 1980 [DE] Fed. Rep. of Germany ..... 3007998

[51] Int. Cl.[3] ..... C11D 7/56; C11D 7/54

[52] U.S. Cl. ..... 252/99; 252/103; 252/187 H

[58] Field of Search ..... 252/103, 99, 187 H, 252/156

[56] References Cited

U.S. PATENT DOCUMENTS

| | | | |
|---|---|---|---|
| 2,607,738 | 8/1952 | Hardy | 252/99 |
| 3,166,513 | 1/1965 | Mizuno et al. | 525/99 |
| 3,178,372 | 4/1965 | Pomot et al. | 252/187 C |
| 3,352,785 | 11/1967 | Corliss et al. | 292/92 |
| 3,390,092 | 6/1968 | Keast et al. | 252/99 |
| 3,491,028 | 1/1970 | Crotty et al. | 252/103 |
| 3,816,320 | 6/1974 | Corliss | 339/100 |
| 3,829,385 | 8/1974 | Abbott, Jr. et al. | 252/95 |
| 4,242,216 | 12/1980 | Daugherty et al. | 252/103 |

OTHER PUBLICATIONS

Soap Cosmetics Chemical Specialties, Aug. 1974.

*Primary Examiner*—M. Weinblatt
*Attorney, Agent, or Firm*—Hammond & Littell, Weissenberger and Muserlian

[57] ABSTRACT

Stable, alkaline, granulated dishwashing agent composition containing active chlorine for use in mechanical dishwashers, having a content of builder salts, alkali metal silicates, alkali metal carbonates and, optionally, nonionic surface-active compounds and containing from 1% to 30% by weight of finely divided trichloroisocyanuric acid in the form of granulates or prills with a total surface area as small as possible and having a degree of purity of ≧ 99% as determined by laser-Raman spectroscopy, and from 10% to 40% by weight of granulated alkali metal hydroxide with a total surface area as small as possible.

12 Claims, No Drawings

STABLE DISHWASHING AGENT COMPOSITIONS CONTAINING ACTIVE CHLORINE

BACKGROUND OF THE INVENTION

The application concerns granulated, alkaline dishwashing agent compositions that contain active chlorine and can be used in a mechanical dishwasher.

Alkaline cleaning agent compositions consisting mainly of builders, alkali metal silicates, alkali metal carbonates and/or alkali metal hydroxides, compounds containing active chlorine and, if desired, nonionic tensides usually are used for the washing of very soiled dishes by machine, especially in the commercial sector. The greater the content of active chlorine compounds in the cleaning agent compositions, the better the cleaning power for tea stains, for example, and the greater the content of alkali metal hydroxide, the better the cleaning effect, particularly for dishes with scorched food residues.

The cleaning agent compositions generally are prepared by the dry mixing of the individual powdered or granular constituents, for example, in rotating drums with the formation of the desired mixed product, where possible liquid components such as nonionic tensides and/or water glass are added as such, or as a mixture or in an aqueous solution, by spraying on the agitated powdered or granular constituents or groups of constituents, causing granulation. The compounds containing active chlorine generally are added at the end. A final product of a free-flowing, powdered or granular consistency that does not lump together during storage and is stable during storage with respect to its constituents is desired in any case. This applies especially to the compound containing active chlorine.

Polychlorinated cyanuric acids and their salts were found especially suitable as compounds containing active chlorine for powdered or granulated dishwashing agent compositions. Trichloroisocyanuric acid always is of great interest because of its highest content of active chlorine. However, its low solubility in water as well as its poor storage qualities are a disadvantage.

It is also known that powder and granulate mixtures become increasingly labile in storage, especially with a rising content of compounds containing active chlorine and alkali metal hydroxides. Under unfavorable storage conditions, for example, at elevated temperature and/or exposure of the packages to moisture, an exothermic spontaneous decomposition of the chlorine vehicle as well as reactions with other components of the cleaning agent composition take place. The cleaning agent composition remaining after the spontaneous decomposition is largely worthless since it sticks together and contains hardly any active chlorine. In addition, this possible spontaneous decomposition naturally represents an undesirable safety risk during storing and handling.

The recommendation was made in U.S. Pat. No. 3,166,513 to use potassium dichloroisocyanurate in granulated form with a critical particle size, as active chlorine component for the stabilization of dishwashing agent compositions with a content of compounds containing active chlorine. Potassium dichloroisocyanurate is considered more stable than the sodium dichloroisocyanurate, and the granulated form is said to provide additional stabilization. The amount of potassium dichloroisocyanurate does not exceed 5% by weight, in these products with a content of up to 30% by weight alkali metal hydroxides.

Potassium dichloroisocyanurate is considerably more expensive than the corresponding sodium compound, however. Thus the information of this patent specification is of theoretical interest only. Furthermore, the comment is made with respect to this patent in U.S. Pat. No. 3,352,785 that unjustifiable losses of available chlorine still occur despite a certain improvement with respect to the storing stability of these products, and formulations are mentioned therebefore that contain sodium dichloroisocyanurate of any desired granulation in the presence of nonionic surfactants and caustic alkalis, which are said to be more stable than cleaning agent compositions with content of granulated potassium dichloroisocyanurates, but the content of sodium dichloroisocyanurate is preferably 5% by weight maximum, even in this case.

A further increase in stability is said to be achieved according to U.S. Pat. No. 3,816,320 when the anhydrous sodium dichloroisocyanurate is replaced with its dihydrate. Its content can then be increased to 10% by weight. However, the dishwashing agent compositions prepared with it no longer contain free alkali metal hydroxide and, therefore, cannot be used for a technical comparison.

The preparation of cleaning agent compositions with a content of trichloroisocyanuric acid, which also are said to be stable in storage, also is known already from the U.S. Pat. No. 2,607,738, but again, these products do not contain any alkali metal hydroxide. This is understandable since it is known from "Soap, Cosmetics, Chemical Specialties," August 1974, pp. 46 to 55, particularly page 48, Table 3, for example, that trichloroisocyanuric acid is decomposed most strongly in the presence of sodium hydroxide flakes as an alkaline compound, as also is potassium and sodium dichloroisocyanurate.

There has been no shortage of experiments to make the use of trichloroisocyanuric acid possible by the concurrent use of stabilizing agents, such as (a) dry trialkali salts of cyanuric acid or a mixture of equivalent amounts of cyanuric acid and alkali hydroxide (U.S. Pat. No. 3,178,372), or (b) sodium acetate (U.S. Pat. No. 3,829,385).

However, these products contain undesirable ballast, such as cyanuric acid and sodium acetate in each case. The practical use of trichloroisocyanuric acid in dishwashing agent compositions with a high content of alkali metal hydroxides thus did not become acceptable although this substance has the highest content of active chlorine and, therefore, its application has always been tempting time and again.

OBJECTS OF THE INVENTION

An object of the present invention is the development of a stable, alkaline, granulated dishwashing agent composition containing active chlorine and alkali metal hydroxides for use in mechanical dishwashers.

Another object of the present invention is the development of a stable, alkaline, granulated dishwashing agent composition containing active chlorine for use in mechanical dishwashers, having a content of builder salts, alkali metal silicates, alkali metal carbonates and, optionally, nonionic surface-active compounds and containing from 1% to 30% by weight of finely divided trichloroisocyanuric acid in the form of granulates or prills with a total surface area as small as possible and having a degree of purity of ≧99% as determined by laser-Raman spectroscopy, and from 10% to 40% by weight of granulated alkali metal hydroxide with a total surface area as small as possible.

A further object of the present invention is the development of a stable, alkaline, granulated dishwashing agent composition containing active chlorine and alkali metal hydroxide for use in mechanical dishwashers consisting essentially of an admixture of:

(a) from 1% to 30% by weight of finely divided trichloroisocyanuric acid in the from of granulates or prills with the total surface area as small as possible and having a degree of purity of ≧99% as determined by laser-Raman spectroscopy, (b) from 10% to 40% by weight of granulated alkali metal hydroxide with a total surface area as small as possible, (c) from 5% to 60% by weight of builders selected from the group consisting of alkali metal polyphosphates and mixtures of said polyphosphates with up to 60% by weight of the builders of synthetic, water-insoluble alkali metal aluminosilicates having a calcium binding capacity of between 50 and 200 mg CaO/gm of anhydrous inorganic active substance, (d) from 5% to 50% by weight of alkali metal silicates, (e) from 2% to 50% by weight of alkali metal carbonates, or sulfates, and (f) from 0 to 5% by weight of nonionic surface-active compounds.

These and other objects of the invention will become more apparent as the description thereof proceeds.

DESCRIPTION OF THE INVENTION

In view of the teachings of the prior art discussed above, applicants were surprised to find, according to the invention, that the use of especially large amounts of granulated trichloroisocyanuric acid with a definite particle size and a high degree of purity and the simultaneous use of large quantities of alkali metal hydroxides, particularly in the form of solid, coarsely granulated or almost spherical prills, also with a definite particle size, prevents a spontaneous decomposition of the resulting cleaning agent compositions practically completely. This is the more surprising as the combination of large amounts of such alkali metal hydroxides with commercial, granulated mono-alkali metal salts of trichloroisocyanuric acid does not produce sufficiently stable product formulations. Even a stabilizing addition of liquid paraffins suggested in U.S. Pat. No. 3,390,092 has become practically superfluous, unless it seems desirable for other reasons.

The fear that trichloroisocyanuric acid is unsuitable for use in dishwashing agents because it is sparsely soluble in water proved to be unfounded in the presence of the large proportion of alkali metal hydroxide in the compositions according to the invention since it strongly accelerates the solubility.

The present invention thus concerns alkaline, granulated dishwashing agent compositions with active chlorine that can be used in machines and have a content of builders, alkali metal silicates, alkali metal carbonates, alkali metal hydroxides and, optionally, nonionic surface-active compounds or tensides, that are characterized by the fact that they contain from 1% to 30%, preferably 3% to 15%, and especially 5% to 15%, by weight of finely divided trichloroisocyanuric acid in the form of a granulate or prills with a total surface area as small as possible and a degree of purity of ≧99%, determined by laser-Raman spectroscopy, and 10% to 40%, preferably 15% to 30%, by weight of granulated alkali metal hydroxide with a total surface area as small as possible.

More particularly, the present invention relates to a stable, alkaline, granulated dishwashing agent composition containing active chlorine for use in mechanical dishwashers, having a content of builder salts, alkali metal silicates, alkali metal carbonates and, optionally, nonionic surface-active compounds and containing from 1% to 30% by weight of finely divided trichloroisocyanuric acid in the form of granulates or prills with a total surface area as small as possible and having a degree of purity of ≧99% as determined by laser-Raman spectroscopy, and from 10% to 40% by weight of granulated alkali metal hydroxide with a total surface area as small as possible.

The finely divided trichloroisocyanuric acid used according to the invention generally had the following particle spectra in percent by weight:

| 1.6 | 0.8 | 0.4 | 0.2 | 0.1 | 0.05 | mm |
|---|---|---|---|---|---|---|
| 1.3 to 15.2 | 47.5 to 80.7 | 50.8 to 3.9 | 0.3 to 0.1 | 0.1 to 0.1 | — | % |
| | | | | | — | % |

which was determined with a set of screens according to DIN (German Industrial Standardized Tests) 4188. Preferably, granulates are employed that contain particles more than 84% of which, preferably more than 95%, and especially more than 98% of which, passed through a screen with the inside mesh diameter of 1.6 mm, and more than 90%, preferably more than 95% and especially more than 99%, of which were retained by a screen with an inside mesh diameter of 0.2 mm.

Another finely divided trichloroisocyanuric acid can be employed with particles, more than 98% by weight of which are retained by a screen with an inside mesh diameter of 0.4 mm, and at the same time more than 55% by weight of which are retained by a screen with an inside mesh diameter of 0.8 mm.

The degree of purity of the trichloroisocyanuric acid was determined by laser-Raman spectroscopy with a Raman spectrometer Model 82 by the company Cary and the following measuring conditions:

Exciting wavelength 647.1 nm (Krypton laser)
Rate 200 mW
Spectral slit width 4 $cm^{-1}$
Sensitivity 200 counts $sec.^{-1}$ full scale (100).

Under the stipulated measuring conditions, secondary bands of contaminants were observed at approximately 600, 1060, 1310 and 1680 $cm^{-1}$ with an intensity of 20 to 40 scale divisions, in addition to the typical bands of trichloroisocyanuric acid.

With a changed sensitivity of 5,000 count $sec.^{-1}$ for full scale deflection, the intensity of the bands present due to contaminants was ≧1% of the intensity of the main bands of trichloroisocyanuric acid. A purity of ≧99% is obtained from this for the anhydrous trichloroisocyanuric acid. Trichloroisocyanuric acids with a degree of purity of ≧97.5% but less than ≧99% were found unsuitable for use in the dishwashing agent compositions according to the invention.

The consistency of the alkali metal hydroxides is of secondary significance. Especially good, dependable and unequivocal results are obtained, however, when granulated alkali metal hydroxides are employed with a small, i.e., possibly spherical surface. Potassium hydroxide and preferably sodium hydroxide in the form of coarse granules, or preferably as so-called prills, are used in this manner. The coarse granules generally have the following particle size distribution in percent by weight as determined by DIN 4188:

| | | | | | | |
|---|---|---|---|---|---|---|
| 1.6 | 0.8 | 0.4 | 0.2 | 0.1 | 0.05 | mm |
| 19.0 | 32.2 | 23.5 | 16.0 | 8.8 | 0.5 | % |

that is, more than 70%, preferably more than 80%, of all particles pass a screen with an inside mesh diameter of 1.6 mm and less than 10% of all particles pass a screen with an inside mesh diameter of 0.2 mm (screen set according to DIN 4188).

The prills used preferably according to the invention generally have the following particle size distribution in percent by weight:

| | | | | | | |
|---|---|---|---|---|---|---|
| 1.6 | 0.8 | 0.4 | 0.2 | 0.1 | 0.05 | mm |
| 63.1 | 36.3 | 0.5 | 0.1 | — | — | % |

that is, the particles are large enough that they practically do not pass through a screen with an inside mesh diameter of 0.2 mm (screen set according to DIN 4188).

The total particle size distribution of >0.2 mm is determined mainly by the other powdered or granular constituents of the respective formulations. It is advantageous to avoid greater differences in particle size of the individual constituents to prevent separation within the products.

The dishwashing agent compositions according to the invention have the following basic formulation:

1% to 30%, preferably 3% to 15% and especially 5% to 15%, by weight of finely divided trichloroisocyanuric acid with a total surface area as small as possible and laser-Raman spectroscopically determined degree of purity of ≧99%;

10% to 40%, preferably 15% to 30%, by weight of finely granulated alkali metal hydroxide with a total surface area as small as possible;

5% to 60%, preferably 20% to 45%, by weight of builders;

5% to 50%, preferably 20% to 40%, by weight of alkali metal silicates;

2% to 50%, preferably 5% to 30%, by weight of alkali metal carbonates or sulfates, as well as 0 to 5%, preferably 0.5% to 1.5%, by weight of nonionic tensides.

More particularly, the dishwashing agent composition of the invention is a stable, alkaline, granulated dishwashing agent composition containing active chlorine and alkali metal hydroxide for use in mechanical dishwashers consisting essentially of an admixture of:

(a) from 1% to 30% by weight of finely divided trichloroisocyanuric acid in the form of granulates or prills with the total surface area as small as possible and having a degree of purity of ≧99% as determined by laser-Raman spectroscopy, (b) from 10% to 40% by weight of granulated alkali metal hydroxide with a total surface area as small as possible.

(c) from 5% to 60% by weight of builders selected from the group consisting of alkali metal polyphosphates and mixtures of said polyphosphates with up to 60% by weight of the builders of synthetic, water-insoluble alkali metal aluminosilicates having a calcium binding capacity of between 50 and 200 mg CaO/gm of anhydrous inorganic active substance, (d) from 5% to 50% by weight of alkali metal silicates, (e) from 2% to 50% by weight of alkali metal carbonates, or sulfates, and (f) from 0 to 5% by weight of nonionic surface-active compounds.

Commercial alkali metal polyphosphates with a molar ratio of from about 1:1 to 2:1 for $Na_2O$ or $K_2O$ to $P_2O_5$ can be used preferably as builders. These include sodium tripolyphosphate, which is used preferably because of cost, sodium hexametaphosphate and sodium pyrophosphate as well as the respective potassium polyphosphates. The particle size is of little consequence in the case of the polyphosphates. Consequently, the commercially available products may be used, and their content of water of hydration is only of secondary importance.

The polyphosphates may be replaced partially also by synthetic, water-insoluble aluminosilicates that also bind the calcium hardness of the water, contain water in the bound state and are of the general formula:

$$(Kat_{2/n}O)_x.Al_2O_3.(SiO_2)_y$$

in which Kat represents a cation of the valency n that is exchangeable with calcium, preferably an alkali metal, such as sodium, x is a number from 0.7 to 1.5, preferably from 0.9 to 1.3, and y is a number from 0.8 to 6, preferably from 1.3 to 4, and having a calcium-binding capacity of between 50 and 200, preferably 100 to 200, mg CaO/gm of anhydrous inorganic active substance, for the purpose of reducing the eutrophication of waters caused by the polyphosphates. Such compounds are sold, for example, under the name SASIL ® by Henkel KGaA, Dusseldorf, Germany. They may amount to 60%, preferably to 25% to 50%, by weight of the builders.

The calcium-binding capacity of the aluminosilicates is determined in the following manner:

One liter of an aqueous solution containing 0.594 gm $CaCl_2$(=300 mg CaO/liter=30° dH) and adjusted to a pH of 10 is mixed with 1 gm of the aluminosilicate (based on the anhydrous active substance). Then the suspension is stirred vigorously for 15 minutes at a temperature of 22° C. (±2° C.). After filtering the aluminosilicate, the residual hardness x of the filtrate is determined. The calcium-binding capacity in mg CaO/gm anhydrous active substance (AS) is calculated from this with the formula:

$$(30-x).10$$

When the calcium binding capacity is determined at elevated temperatures, for example, at 60° C., the values are all better than at 22° C. This fact distinguishes the aluminosilicates from most of the soluble complexing agents recommended until now for use in washing agents, and their use represents a special technical progress.

The alkali metal silicates that were used act mainly as corrosion inhibitors for the metal parts in dishwashers. Preferred as soluble alkali metal silicates are those with an alkali metal oxide:silicon dioxide ratio of about 1:0.5 to 3.5. The anhydrous silicates are preferably employed. Also suitable for use in the cleaning agents according to the invention are the disilicates with an alkali metal oxide:silicon dioxide ratio of 1:2, but most suitable are the sodium or potassium metasilicates with an alkali metal oxide:silicon oxide ratio of about 1:1.

Most suitable of the alkali metal carbonates are sodium and potassium carbonates without water of hydration. The carbonates are used mainly as fillers. If desired, they may be replaced partly or completely by the corresponding sulfates.

Suitable nonionic surface-active compounds or tensides that may be used if desired are those that do not decompose in the presence of compounds containing active chlorine and alkali metal hydroxides. Moreover tensides that develop little foam are most suitable. These are preferably ethylene oxide adducts of higher molecular weight polypropylene glycols with molar weights of 900 to 4,000 as well as adducts of ethylene oxide or mixtures of ethylene oxide and propylene oxide with higher fatty alcohols, such as dodecyl alcohol, palmityl alcohol, stearyl alcohol, oleyl alcohol or their mixtures as well as synthetic alkanols of the chain lengths $C_{12}$–$C_{18}$ prepared by oxosynthesis and corresponding alkylene oxide adducts with alkylphenols having from 6 to 18 carbon atoms in the alkyl, preferably nonylphenol.

Examples of suitable addition products are the adduct of 10% to 30% by weight of ethylene oxide onto a polyoxypropylene glycol of the molar weight 1,750, the adduct of 20 mols of ethylene oxide or of 9 mols of ethylene oxide and 10 mols of propylene oxide onto nonylphenol, the adduct of 5 to 12 mols of ethylene oxide onto a mixture of higher fatty alcohols with the chain lengths $C_{12}$–$C_{18}$ with a content of about 30% oleyl alcohol, and similar substances. This enumeration of examples does not represent a limitation.

Dyes and fragrances that are resistant to chlorine and alkalis may be added to the dishwashing agent compositions as they are needed.

The dishwashing agent compositions according to the invention were prepared in one experiment by simple mixing of the powder or granulate components in a conventional mixing drum.

However, granulates may be prepared as well. For these, a so-called basic granulate was prepared which contained the builders, alkali metal carbonates, alkali metal silicates and tensides, with the mostly liquid nonionic tensides as well as possibly liquid silicates or those dissolved in water being sprayed in a controlled manner, individually or as mixture with the liquid tensides, onto the dry, agitated and, therefore, well mixed solid granulate constituents. Lödige and Eirich mixers can be used as granulators. Then, this basic granulate was mixed with corresponding amounts of finely divided trichloroisocyanuric acid and alkali metal hydroxides in the form of prills or coarse particles. The respective particle sizes were determined by screening separation. To prevent separation into individual components of the mixture, the basic granulate, the chlorine carrier and the alkali metal hydroxide were used in largely corresponding particle sizes. The obtained dishwashing granulate was loose and free-flowing and did not stick together during storing nor did it show signs of separation after a shaking process simulating transportation conditions.

The trichloroisocyanuric acids I, II, III and IV used in the Examples according to the invention and in the comparison formulations given below as well as NaOH of coarse particle size or NaOH-prills had the following degree of purity and/or particle size distribution, determined with a screen set according to DIN 4188.

TABLE 1

Particle Size Distribution of Various Starting Materials

| Content (%) | Screen (mm) 1.6 | 0.8 | 0.4 | 0.2 | 0.1 | 0.05 |
|---|---|---|---|---|---|---|
| NaOH, coarse particles | 19.0 | 32.2 | 23.5 | 16.0 | 8.8 | 0.5 |
| NaOH prills | 63.1 | 36.3 | 0.5 | 0.1 | — | — |
| Trichloroisocyanuric acid I, degree of purity ≧ 99% | 1.3 | 47.5 | 50.8 | 0.3 | 0.1 | — |
| Trichloroisocyanuric acid II, degree of purity ≧ 97.5%, <99% | 4.7 | 75.5 | 17.9 | 1.9 | — | — |
| Trichloroisocyanuric acid III, degree of purity ≧ 97.5%, <99% | 0.5 | 38.5 | 49.0 | 3.0 | 5.0 | 4.0 |
| Trichloroisocyanuric acid IV, degree of purity ≧ 99% | 15.2 | 80.7 | 3.9 | 0.1 | 0.1 | — |
| Potassium dichloroisocyanurate, anhydrous commercial grade | — | 0.4 | 38.7 | 54.9 | 4.8 | 1.2 |
| Sodium dichloroisocyanurate, anhydrous, commercial grade | 0.4 | 57.8 | 40.7 | 0.4 | 0.4 | 0.3 |
| Sodium dichloroisocyanurate dihydrate, commercial grade | — | 0.1 | 45.1 | 52.0 | 1.8 | 1.0 |

The following examples are illustrative of the invention without being limitative in any manner.

The compositions of Examples 1 to 6 consisted of a mixture of the individual constituents.

EXAMPLE 1

Mixed product consisting of:

| Percent By Weight | |
|---|---|
| 50 | Pentasodium triphosphate |
| 15 | Sodium metasilicate, anhydrous |
| 20 | NaOH, coarse particles |
| 10 | Sodium carbonate, anhydrous |
| 5 | Trichloroisocyanuric acid I. |

EXAMPLE 2

Mixed product consisting of:

| Percent By Weight | |
|---|---|
| 50 | Pentasodium triphosphate |
| 10 | Sodium metasilicate, anhydrous |
| 20 | NaOH prills |
| 12 | Sodium carbonate, anhydrous |
| 8 | Trichloroisocyanuric acid I. |

With the same recipe, a corresponding preparation was prepared employing trichloroisocyanuric acid IV. This showed the same stability as the above preparation.

EXAMPLE 3

Mixed product consisting of:

| Percent By Weight | |
|---|---|
| 44 | Pentasodium triphosphate |
| 15 | Sodium metasilicate, anhydrous |
| 20 | Sodium hydroxide, coarse particles |
| 11 | Sodium carbonate, anhydrous |
| 10 | Trichloroisocyanuric acid I. |

EXAMPLE 4

Mixed product consisting of:

| Percent By Weight | |
|---|---|
| 30 | Pentasodium triphosphate |
| 20 | Sodium metaphosphate, anhydrous |
| 8 | Sodium carbonate, anhydrous |
| 30 | NaOH prills |
| 12 | Trichloroisocyanuric acid I. |

EXAMPLE 5

Mixed product consisting of:

| Percent By Weight | |
|---|---|
| 50.0 | Pentasodium triphosphate |
| 15.5 | Sodium metasilicate, anhydrous |
| 10.0 | Sodium carbonate, anhydrous |
| 20.0 | NaOH, coarse particles |
| 4.5 | Trichloroisocyanuric acid I. |

EXAMPLE 6

Mixed product consisting of:

| Percent By Weight | |
|---|---|
| 42 | Pentasodium triphosphate |
| 16 | Sodium metasilicate |
| 9 | Sodium carbonate, anhydrous |
| 30 | NaOH prills |
| 3 | Trichloroisocyanuric acid I. |

EXAMPLE 7

Granulate consisting of:

| Percent By Weight | |
|---|---|
| | Basic granulate |
| 33.0 | Pentasodium triphosphate |
| 8.0 | Sodium carbonate, anhydrous |
| 0.5 | Nonionic tenside |
| 25.0 | Sodium metasilicate, anhydrous |
| 3.5 | Water glass 37/40 |
| 5.5 | Water |
| and the admixture thereto of: | |
| 20.0 | NaOH, coarse particles |
| 4.5 | Trichloroisocyanuric acid I. |

EXAMPLE 8

Granulate consisting of:

| Percent By Weight | |
|---|---|
| | Basic granulate |
| 36.3 | Pentasodium triphosphate |
| 20.0 | Sodium metasilicate, anhydrous |
| 5.6 | Sodium carbonate, anhydrous |
| 0.4 | Liquid paraffin |
| 3.2 | Water glass |
| 6.3 | Water |
| and the admixture thereto of: | |
| 25.0 | NaOH prills |
| 3.2 | Trichloroisocyanuric acid I. |

COMPARISON TESTS

The following experiments were performed to determine the stability of the cleaning agents according to the invention in comparison to commercial cleaning agents with a content of granulated sodium dichloroisocyanurate dihydrate.

50 kg of the powders or granulates prepared according to Examples 1 to 4 were filled into 60-liter polyethylene drums as they are used for shipping and closed with covers and clamping ring. In duplicate experiments, the products in these containers were heated to 65° to 70° C. bottom temperature on barrel heating equipment. The testing time was reduced to a practical period in this manner. Otherwise, this period extends from a few days to ten weeks under actual application conditions. The internal temperature of the containers was recorded continuously against the time.

Even after 200 hours and at a bottom temperature of 70° C., with fluctuation of ±4° C., no spontaneous decomposition occurred. However, when the trichloroisocyanuric acid I was replaced by granulated sodium dichloroisocyanurate dihydrate in an amount with an identical content of active chlorine in Example 1, a violet spontaneous decomposition occurred in the duplicate test after 14.5 hours or after 12.5 hours. The internal temperature of the product rose to about 165° C. to 170° C. After the completion of the spontaneous decomposition, the cover of the container had buckled and become warped due to the influence of the heat. The product itself was solid and hard as a rock after cooling. The content of active chlorine dropped from the initial value of 4.55% to a final value of 0.43% and thus had become completely useless.

A product of the composition according to Example 2 was tested under the same experimental conditions as stated above and the expected spontaneous decomposition did not occur. When the trichloroisocyanuric acid I was replaced by granulated sodium dichloroisocyanurate dihydrate with an identical content of active chlorine, a violent spontaneous decomposition process set in as early as 7.5 hours later. The final reaction temperature was 220° C. The plastic shell of the polyethylene container had melted through and the product ran out. The content of active chlorine dropped from 7.3% for the fresh mixture to a final value of 0.5%. Even the use of sodium hydroxide prills, which are practically free of dust particles, did not prevent the spontaneous decomposition of this product.

Corresponding tests with a composition or comparison according to Examples 3 and 4 led, with the use of granulated sodium dichloroisocyanurate dihydrate, to an onset of spontaneous decomposition after 3.5 or 16 hours, respectively, with the development of a highest temperature of 240° C. or 185° C., respectively.

Additional experiments were performed in the equipment described below to determine the influence of the degree of purity of the anhydrous granulated trichloroisocyanuric acid. Corresponding cleaning agents with a commercial composition also were tested under these comparable conditions.

The experimental equipment consisted of a beaker-shaped glass pressure vessel with a volume of one liter that was enclosed by a heating jacket. This pressure vessel was charged with one kg of one of the Mixtures 1 to 4 described below and sealed tightly toward the top with an insulating layer of asbestos board or rock wool. Temperature sensors were introduced through the attached ground glass cover, which was equipped with a gas vent and two openings for the measuring sensors and connected to the pressure vessel with a ring clamp, and brought to the edge of the pressure vessel and into the center of the mixture.

The pressure vessel was insulated adequately so that a heat exchange with the outside was prevented. The pressure in the vessel was kept constant by the removal of evolving gases. The pressure vessel was heated to a "base temperature," which is constant in dependence on the composition, by means of an adjustable jacket and bottom heat to initiate the spontaneous decomposition of the powdered cleaning agent mixtures. That time in minutes after which the heat shut off automatically, was determined as the so-called "initial time." This took place at the time at which the temperature of the reaction mixture rose above the base temperature. The temperature in dependence on the time was measured with iron-constantan resistance thermoelements in the center and near the jacket of the pressure vessel. The highest temperature reached in the center of the reaction mixture in dependence on the time was determined. The results are compiled in Table 2.

COMPARISON EXPERIMENT 1

| Percent By Weight | |
|---|---|
| 50 | Pentasodium triphosphate |
| 15 | Sodium metasilicate, anhydrous |
| 20 | NaOH, coarse particles |
| 7 | Sodium carbonate, anhydrous |
| 8 | Sodium dichloroisocyanurate dihydrate |

COMPARISON EXPERIMENT 2

| Percent By Weight | |
|---|---|
| 50 | Pentasodium triphosphate |
| 15 | Sodium metasilicate, anhydrous |
| 20 | NaOH, coarse particles |
| 7 | Sodium carbonate, anhydrous |
| 8 | Sodium dichloroisocyanurate, anhydrous. |

COMPARISON EXPERIMENT 3

| Percent By Weight | |
|---|---|
| 50 | Pentasodium triphosphate |
| 15 | Sodium metasilicate, anhydrous |
| 20 | NaOH, coarse particles |

-continued

| Percent By Weight | |
|---|---|
| 7 | Sodium carbonate, anhydrous |
| 8 | Potassium dichloroisocyanurate, anhydrous. |

EXPERIMENT 4

| Percent By Weight | |
|---|---|
| 50 | Pentasodium triphosphate |
| 15 | Sodium metasilicate, anhydrous |
| 20 | NaOH, coarse particles |
| 9 | Sodium carbonate, anhydrous |
| 6 | Trichloroisocyanuric acid I. |

COMPARISON EXPERIMENT 5

| Percent By Weight | |
|---|---|
| 50 | Pentasodium triphosphate |
| 15 | Sodium metasilicate, anhydrous |
| 20 | NaOH, coarse particles |
| 9 | Sodium carbonate, anhydrous |
| 6 | Trichloroisocyanuric acid II. |

COMPARISON EXPERIMENT 6

| Percent By Weight | |
|---|---|
| 50 | Pentasodium triphosphate |
| 15 | Sodium metasilicate, anhydrous |
| 20 | NaOH prills |
| 7 | Sodium carbonate, anhydrous |
| 8 | Potassium dichloroisocyanurate, anhydrous. |

EXPERIMENT 7

| Percent By Weight | |
|---|---|
| 50 | Pentasodium triphosphate |
| 15 | Sodium metasilicate, anhydrous |
| 20 | NaOH prills |
| 9 | Sodium carbonate, anhydrous |
| 6 | Trichloroisocyanuric acid I. |

COMPARISON EXPERIMENT 8

| Percent By Weight | |
|---|---|
| 50 | Pentasodium triphosphate |
| 15 | Sodium metasilicate, anhydrous |
| 20 | NaOH prills |
| 9 | Sodium carbonate, anhydrous |
| 6 | Trichloroisocyanuric acid II. |

COMPARISON EXPERIMENT 9

| Percent By Weight | |
|---|---|
| 50 | Pentasodium triphosphate |
| 15 | Sodium metasilicate, anhydrous |

-continued

| Percent By Weight | |
|---|---|
| 20 | NaOH prills |
| 9 | Sodium carbonate, anhydrous |
| 6 | Trichloroisocyanuric acid III. |

TABLE 2

Initial Times of the Spontaneous Decomposition of Experiments 1 to 9

| Experiments | Initial Time (Min.) | Final reaction Temperature (°C.) in Center of Mixture | Base Temperature (°C.) |
|---|---|---|---|
| C1 | 86 | 95 | 65 |
| C2 | 77 | 102 | 65 |
| C3 | 93 | 98 | 65 |
| 4 | 205 | 91 | 65 |
| C5 | 148 | 96 | 65 |
| C6 | 105 | 98 | 125 |
| 7 | 156 | 140 | 125 |
| C8 | 99 | 256 | 125 |
| C9 | 144 | 165 | 125 |

The experimental results compiled in Table 2 show that the stability of the cleaning agent mixtures (reaction mixtures) was greater in every case when trichloroisocyanuric acid was used instead of various known alkali metal dichloroisocyanurates (Experiments 4, 5, 7, 8 and 9 compared with Experiments 1, 2, 3 and 6), and that it increased with the use of trichloroisocyanuric acid of greater purity and larger particle size (Experiments 4 and 7 compared with the Experiments 5, 8 and 9).

Optimal results were obtained even when the NaOH was used in the form of prills practically without any fine particle content of <0.2 mm (Experiment 7). Here, base temperatures of 125° C. were needed to initiate the spontaneous decomposition.

The cleaning agents mentioned in Examples 5 to 8 were stored 24 weeks, respectively at room temperature between 17° and 24° C. as well as at 35° C. and 70% relative humidity in watertight containers, in the climate cabinet.

Examples 5 to 8 were varied by replacing the trichloroisocyanuric acid (TCI) "I" used according to the invention with identical amounts of two other trichloroisocyanuric acids "II" and "III" with a lower degree of purity, respectively (Samples 1 to 4 A or B). In addition, the trichloroisocyanuric acid was replaced with correspondingly larger amounts of potassium dichloroisocyanurate (KDCIC) as well as sodium dichloroisocyanurate (NaDCIC) in anhydrous as well as in dihydrate form, which yielded the same quantities of active chlorine. The content of pentasodium triphosphate was reduced correspondingly (Samples 1 to 4 C or D). The compositions of the samples were exposed in identical amounts to the storage conditions given for Examples 5 to 8. Finally, the content of active chlorine of all samples with unchanged, good flow characteristics was determined iodometrically. Table 3 below shows that the storage behavior is markedly better with the use of trichloroisocyanuric acid I than with the other active chlorine carriers.

TABLE 3

| Sample | Storage Conditions: Loss of Active Chlorine After 24 Weeks at Room Temperature % | Storage Conditions: Loss of Active Chlorine After 24 Weeks at Cabinet Temperature % |
|---|---|---|
| 1 With TCIC I | 1.1 | 20.0 |
| 1A With TCIC II | 29.0 | 68.0 |
| 1B With TCIC III | 31.0 | 75.0 |
| 1C With NaDCIC × 2 $H_2O$ | 12.0 | 36.0 |
| 2 With TCIC I | 0.5 | 18.0 |
| 2A With TCIC II | 25.0 | 49.0 |
| 2B With TCIC III | 29.0 | 58.0 |
| 2C With NaDCIC × 2 $H_2O$ | 15.0 | 28.0 |
| 2D With KDCIC | 14.0 | 42.0 |
| 3 With TCIC I | 4.6 | 25.0 |
| 3A With TCIC II | 36.0 | 65.0 |
| 3B With TCIC III | 35.0 | 61.0 |
| 3C With NaDCIC × 2 $H_2O$ | 18.0 | 49.0 |
| 4 With TCIC I | 1.8 | 29.0 |
| 4A With TCIC II | 31.0 | 76.0 |
| 4B With TCIC III | 33.0 | 56.0 |
| 4C With NaDCIC × 2 $H_2O$ | 16.0 | 45.0 |
| 4D With NaDCIC | 29.0 | 65.0 |

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. A stable, alkaline, granulated dishwashing agent composition containing active chlorine and alkali metal hydroxide for use in mechanical dishwashers consisting essentially of an admixture of:

(a) from 1% to 30% by weight of finely divided trichloroisocyanuric acid in the form of granulates or prills having particles of which more than 84% by weight pass through a screen with an inside mesh diameter of 1.6 mm and more than 90% by weight are retained by a screen with the inside mesh diameter of 0.2 mm and having a degree of purity of ≧99% as determined by laser-Raman spectroscopy, (b) from 10% to 40% by weight of granulated alkali metal hydroxide having particles of which more than 80% by weight pass through a screen with an inside mesh diameter of 1.6 mm and less than 10% by weight pass through a screen with an inside mesh diameter of 0.2 mm, (c) from 5% to 60% by weight of builders selected from the group consisting of alkali metal polyphosphates and mixtures of said polyphosphates with up to 60% by weight of the builders of synthetic, water-insoluble alkali metal aluminosilicates having a calcium binding capacity of between 50 and 200 mg CaO/gm of anhydrous inorganic active substance, (d) from 5% to 50% by weight of alkali metal silicates, (e) from 2% to 50% by weight of alkali metal carbonates, or sulfates, and (f) from 0 to 5% by weight of nonionic surface-active compounds.

2. The composition of claim 1 containing from 3% to 15% by weight of said trichloroisocyanuric acid and from 15% to 30% by weight of said alkali metal hydroxide.

3. The composition of claim 1 containing from 5% to 15% by weight of said trichloroisocyanuric acid and from 15% to 30% by weight of said alkali metal hydroxide.

4. The composition of claim 1 or 2 or 3 wherein said finely divided trichloroisocyanuric acid has particles of which more than 95% by weight pass through a screen with an inside mesh diameter of 1.6 mm and more than 95% by weight are retained by a screen with the inside mesh diameter of 0.2 mm.

5. The composition of claim 4 wherein said granulated alkali metal hydroxide has particles of which more than 80% by weight pass through a screen with an inside mesh diameter of 1.6 mm and less than 10% by weight pass through a screen with an inside mesh diameter of 0.2 mm.

6. The composition of claim 1 or 2 or 3 wherein said finely divided trichloroisocyanuric acid has particles of which more than 98% by weight pass through a screen with an inside mesh diameter of 1.6 mm and more than 99% by weight are retained by a screen with the inside mesh diameter of 0.2 mm.

7. The composition of claim 6 wherein said granulated alkali metal hydroxide has particles of which more than 80% by weight pass through a screen with an inside mesh diameter of 1.6 mm and less than 10% by weight pass through a screen with an inside mesh diameter of 0.2 mm.

8. The composition of claim 1 or 2 or 3 wherein said finely divided trichloroisocyanuric acid has particles of which over 98% by weight of which are retained by a screen with an inside mesh diameter of 0.4 mm and at the same time over 55% by weight of which are retained by a screen with an inside mesh diameter of 0.8 mm.

9. The composition of claim 8 wherein said granulated alkali metal hydroxide has particles of which more than 80% by weight pass through a screen with an inside mesh diameter of 1.6 mm and less than 10% by weight pass through a screen with an inside mesh diameter of 0.2 mm.

10. The composition of claim 9 wherein said granulated alkali metal hydroxide is sodium hydroxide prills, practically 100% by weight of which pass through a screen with an inside mesh diameter of 1.6 mm and which contains practically no particles with a size of less than 0.2 mm.

11. The composition of claim 1 wherein:

component (a) is present in an amount of from 3% to 15% by weight, component (b) is present in an amount of from 15% to 30% by weight, component (c) is present in an amount of from 20% to 45% by weight, component (d) is present in an amount of from 20% to 40% by weight, component (e) is present in an amount of from 5% to 30% by weight, and component (f) is present in an amount of from 0.5% to 15% by weight.

12. The composition of claim 11 wherein said component (a) is present in an amount of from 5% to 15% by weight.

* * * * *